US007364209B2

(12) United States Patent
Lomicka et al.

(10) Patent No.: US 7,364,209 B2
(45) Date of Patent: Apr. 29, 2008

(54) MECHANICAL LATCH ASSEMBLY

(75) Inventors: Joe Lomicka, La Verne, CA (US); Zhirong Wang, La Verne, CA (US); Min Zhao, Shanghai (CN); Wei Xu, La Verne, CA (US); Lijun Lu, La Verne, CA (US)

(73) Assignee: HTI Technology & Industries Corp., La Verne, CA (US)

( * ) Notice: Subject to any disclaimer, the term of this patent is extended or adjusted under 35 U.S.C. 154(b) by 185 days.

(21) Appl. No.: 10/970,057

(22) Filed: Oct. 19, 2004

(65) Prior Publication Data

US 2005/0194792 A1 Sep. 8, 2005

Related U.S. Application Data

(60) Provisional application No. 60/551,672, filed on Mar. 8, 2004.

(51) Int. Cl.
*E05C 19/10* (2006.01)
*E05C 3/04* (2006.01)

(52) U.S. Cl. ..... 292/95; 292/100; 292/108; 292/200; 292/210; 292/DIG. 65; 292/DIG. 66; 292/DIG. 69

(58) Field of Classification Search ..... 292/95, 292/96, 100, 108, 194, 195, 200, 210, DIG. 65, 292/DIG. 66, DIG. 69; 126/191, 192, 197; 70/DIG. 10
See application file for complete search history.

(56) References Cited

U.S. PATENT DOCUMENTS 3,438,666 A * 4/1969 Erickson ..... 292/210
3,540,767 A * 11/1970 Siegel ..... 292/210
3,625,197 A * 12/1971 Pirker et al. ..... 126/273 R
3,784,776 A * 1/1974 Asanuma ..... 219/724
4,013,312 A * 3/1977 DeWeese ..... 292/113
4,032,180 A * 6/1977 Pohl ..... 292/341.16
4,133,337 A * 1/1979 Shea ..... 126/197
4,174,860 A * 11/1979 Shea ..... 292/113
4,364,589 A * 12/1982 Watson ..... 292/113
4,718,705 A * 1/1988 Case ..... 292/201
4,838,586 A * 6/1989 Henne ..... 292/113
4,862,870 A * 9/1989 Fox ..... 126/197
4,995,650 A * 2/1991 Schantz et al. ..... 292/201
5,419,305 A * 5/1995 Hanley ..... 129/197
5,456,243 A * 10/1995 Jones ..... 126/197
5,493,099 A * 2/1996 McWilliams, III ..... 219/413
6,402,208 B1 * 6/2002 Shimizu ..... 292/123
6,474,702 B1 * 11/2002 Malone et al. ..... 292/97
6,966,582 B1 * 11/2005 Malone et al. ..... 292/95

* cited by examiner

*Primary Examiner*—Carlos Lugo
(74) *Attorney, Agent, or Firm*—Raymond Y. Chan; David and Raymond Patent Firm

(57) ABSTRACT

A mechanical latch assembly includes a supporting frame, a locking latch, an actuation arrangement and a safety lock arrangement. The locking latch is slidably mounted on the supporting frame in longitudinally movable manner. The actuation arrangement includes an actuation handle pivotally connected to the supporting frame to longitudinally drive the locking latch moving between a locked position an unlocked position. Moreover, the safety lock arrangement includes a locker member movably mounted on the supporting frame, wherein the locker member has a slider slot formed thereon to define a pusher surface and an opposed retracting surface, and a thermal activated arm substantially extended from the supporting frame to slidably pass through the slider slot of the locker member at a safety temperature, and adapted to deflect to push the locker member at the pusher surface at an elevated operation temperature.

12 Claims, 10 Drawing Sheets

MECHANICAL LATCH ASSEMBLY

CROSS REFERENCE OF RELATED APPLICATION

This application is a regular application of a provisional application, having an application No. 60/551,672 filed on Mar. 8, 2004.

BACKGROUND OF THE PRESENT INVENTION

1. Field of Invention

The present invention relates to a latch, and more particularly to a mechanical latch assembly which is adapted to lock up a door, such as an oven door, to a main housing, such as an oven housing, in accordance with a temperature thereof.

2. Description of Related Arts

Conventional latch assemblies are widely utilized for locking a door, such as an oven door, to a main housing, such as an oven housing, for a wide variety of purposes. A main concern for such conventional latch assemblies is the safety issue in using them. For example, how to ensure that the door, such as the oven door, is kept securely locked to the main housing, such as the oven housing when, say, the oven is operating has become a pressing problem for engineers. The main difficulty is that while it is relatively easy to lock the door to the main housing, it is not that easy to prevent accidental or undesirable unlocking so that any heat treatment taking place inside the main housing may cause a great risk to the people nearby.

Moreover, it is generally difficult to coordinate the locking and unlocking with the operation of the main housing, so that in many circumstances, electronics apparatuses or some sorts of artificial intelligence have to be utilized for simply doing such a function. However, once such electronics apparatuses or artificial intelligence are employed, the overall purchasing and the running costs will inevitably rise.

As a matter of fact, there exists a conventional latch assembly which comprises a supporting base, a locking latch pivotally connected to a manual handle which is adapted to drive the locking latch moving between a locked position where the locking latch is arranged to engage with the door so as to lock up the door with the main housing, and an unlocked position where the locking latch is arranged to disengage with the door so as to dismantle any locking interaction between the door and the main housing.

Furthermore, this conventional latch assembly further comprises a mechanical lock piece pivotally connected to the supporting base for restricting a pivotal movement of the manual handle so as to lock up the locking latch in its locked position. Typically, this mechanical lock piece is actuated by some sorts of mechanical arrangements such as a spiral coil which is capable of distorting when subject to elevated temperature and restoring to its original shape when the temperature goes down to the original level. As such, the mechanical lock piece is adapted to move to lock up the manual handle in accordance with the temperature to which the mechanical lock piece is subjected.

A main disadvantage of this conventional latch assembly is that the performance of the spiral coil is generally unstable and cannot be accurately predicted. As a result, it may be that the response time of the spiral coil is too slow that the manual handle is still kept locked when it is necessary to open the door on which the latch assembly is engaged.

Alternatively, it may be that the response time is too fast that the door cannot be safely locked.

SUMMARY OF THE PRESENT INVENTION

A main object of the present invention is to provide a mechanical latch assembly which is adapted to lock and unlock a door with respect to a main housing in accordance with a temperature thereof.

Another object of the present invention is to provide a mechanical latch assembly which is adapted to carry out a locking operation when the main housing is in a predetermined operation temperature, such as an elevated operation temperature for industrial heat treatment, and to carry out an unlocking operation when the temperature of the main housing lowers to a predetermined safety temperature, such as a normal room temperature.

Another object of the present invention is to provide a mechanical latch assembly wherein a locking and unlocking thereof is determined by an accurate mechanical response of a safety lock arrangement so that no electronic control to the mechanical latch assembly is necessary. In other words, a manufacturing cost and the ultimate selling price of the present invention can be minimized.

Another object of the present invention is to provide a mechanical latch assembly which comprises a supporting frame which is more compact when compared with that of conventional lock assembly, so as to enhance the compatibility to different applications of the present invention.

Accordingly, in order to accomplish the above objects, the present invention provides a mechanical latch assembly, comprising:

a supporting frame;

a locking latch slidably mounted on the supporting frame in longitudinally movable manner;

an actuation arrangement comprising an actuation handle pivotally connected to the supporting frame to longitudinally drive the locking latch moving between a locked position that the locking latch is outwardly slid on the supporting frame and an unlocked position that the locking latch is inwardly slid on the supporting frame; and a safety lock arrangement, comprising:

a locker member movably mounted on the supporting frame, wherein the locker member has a slider slot formed thereon to define a pusher surface and an opposed retracting surface; and a thermal activated arm substantially extended from the supporting frame to slidably pass through the slider slot of the locker member at a safety temperature, wherein when the thermal activated arm is heated up at an operation temperature, the thermal activated arm is deflected to push the locker member at the pusher surface such that the locker member is moved to engage with the actuation arrangement so as to lock up the actuation handle while the locking latch is at the locked position, wherein when the thermal activated arm is cooled down to the safety temperature, the thermal activated arm is restored to push the locker member at the retracting surface that the locker member is normally disengaged with the actuation arrangement such that the actuation handle is allowed to actuate the locking latch to the unlocked position.

These and other objectives, features, and advantages of the present invention will become apparent from the following detailed description, the accompanying drawings, and the appended claims.

DETAILED DESCRIPTION OF THE PREFERRED EMBODIMENTS

Figure 1:
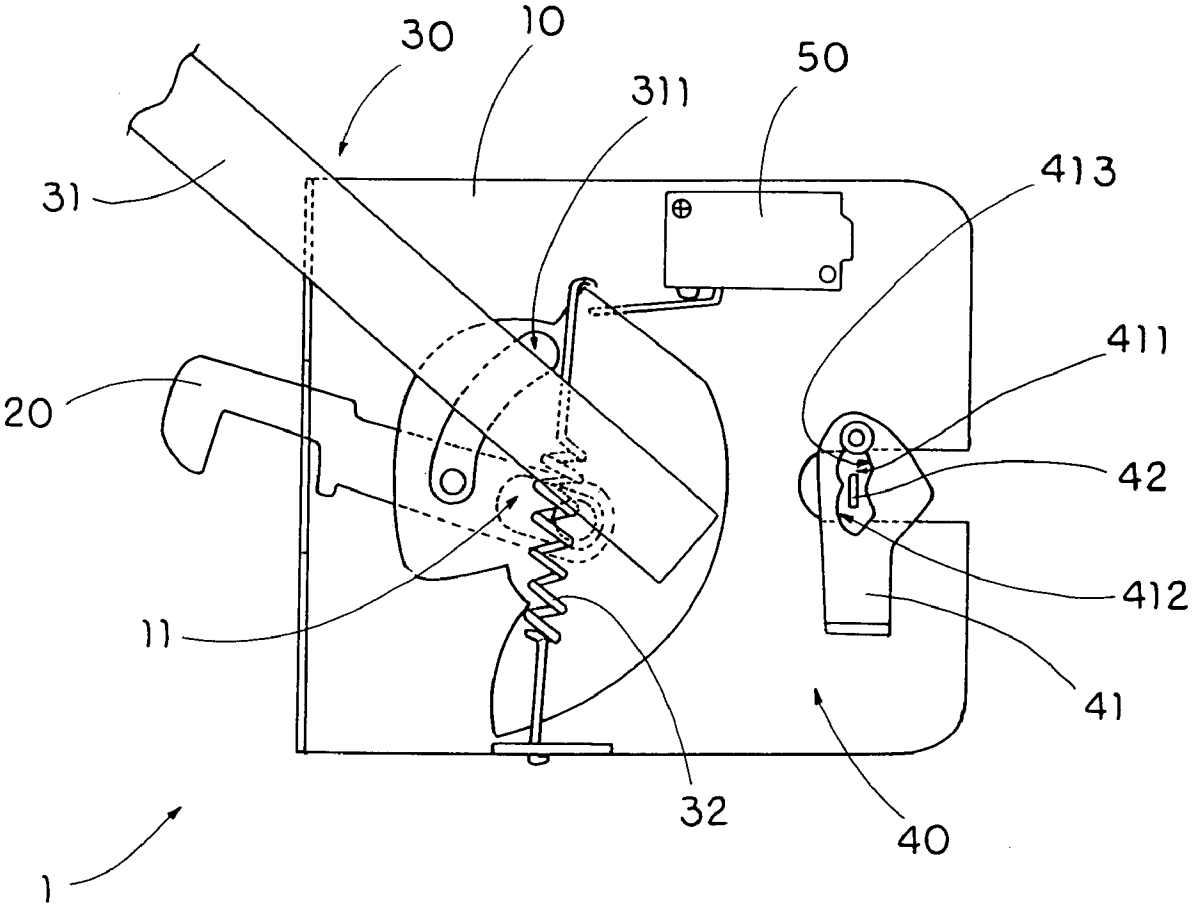
FIG. 1 is a plan view of a mechanical latch assembly according to a first preferred embodiment of the present invention.

Referring to FIG. 1 of the drawings, a mechanical latch assembly 1 according to a first preferred embodiment of the present invention is illustrated, in which the mechanical latch assembly 1 comprises a supporting frame 10, a locking latch 20, an actuation arrangement 30, and a safety lock arrangement 40. The locking latch 20 is slidably mounted on the supporting frame 10 in a longitudinally movable manner so as to lock and unlock a door, such as an oven door with respect to a main housing, such as an oven housing.

Figure 2:
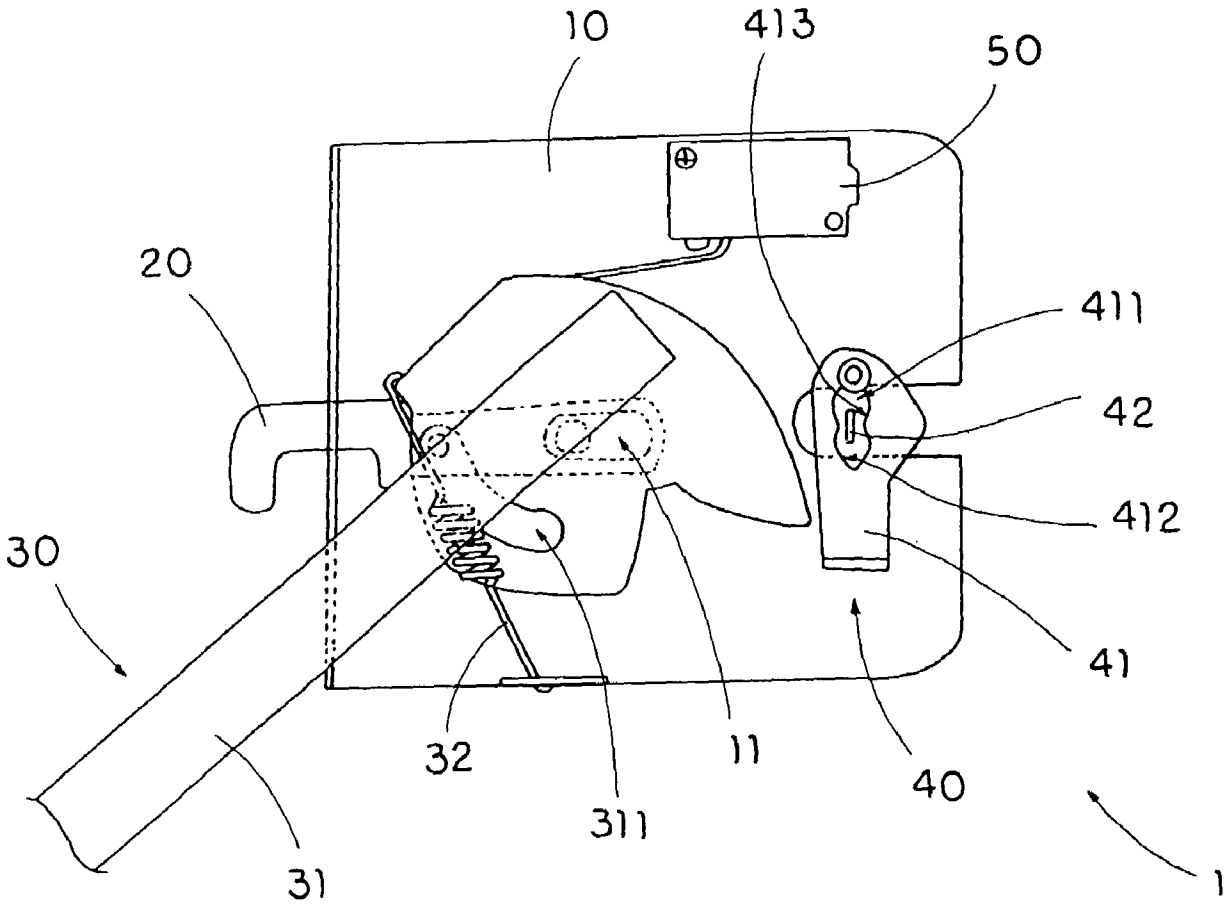
FIG. 2 is a schematic diagram of the mechanical latch assembly according to the above first preferred embodiment of the present invention, illustrating that the locking latch is in the locked position while the locker member is subject to the safety temperature.

Referring to FIG. 1 to FIG. 2 of the drawings, the actuation arrangement 30 comprises an actuation handle 31 pivotally connected to the supporting frame 10 to longitudinally drive the locking latch 20 moving between a locked position where the locking latch 20 is outwardly slid on the supporting frame 10 and an unlocked position where the locking latch 20 is inwardly slid on the supporting frame 10.

Moreover, the safety lock arrangement 40 comprises a locker member 41 movably mounted on the supporting frame, wherein the locker member 41 has a slider slot 411 formed thereon to define a pusher surface 412 and an opposed retracting surface 413.

Figure 3:
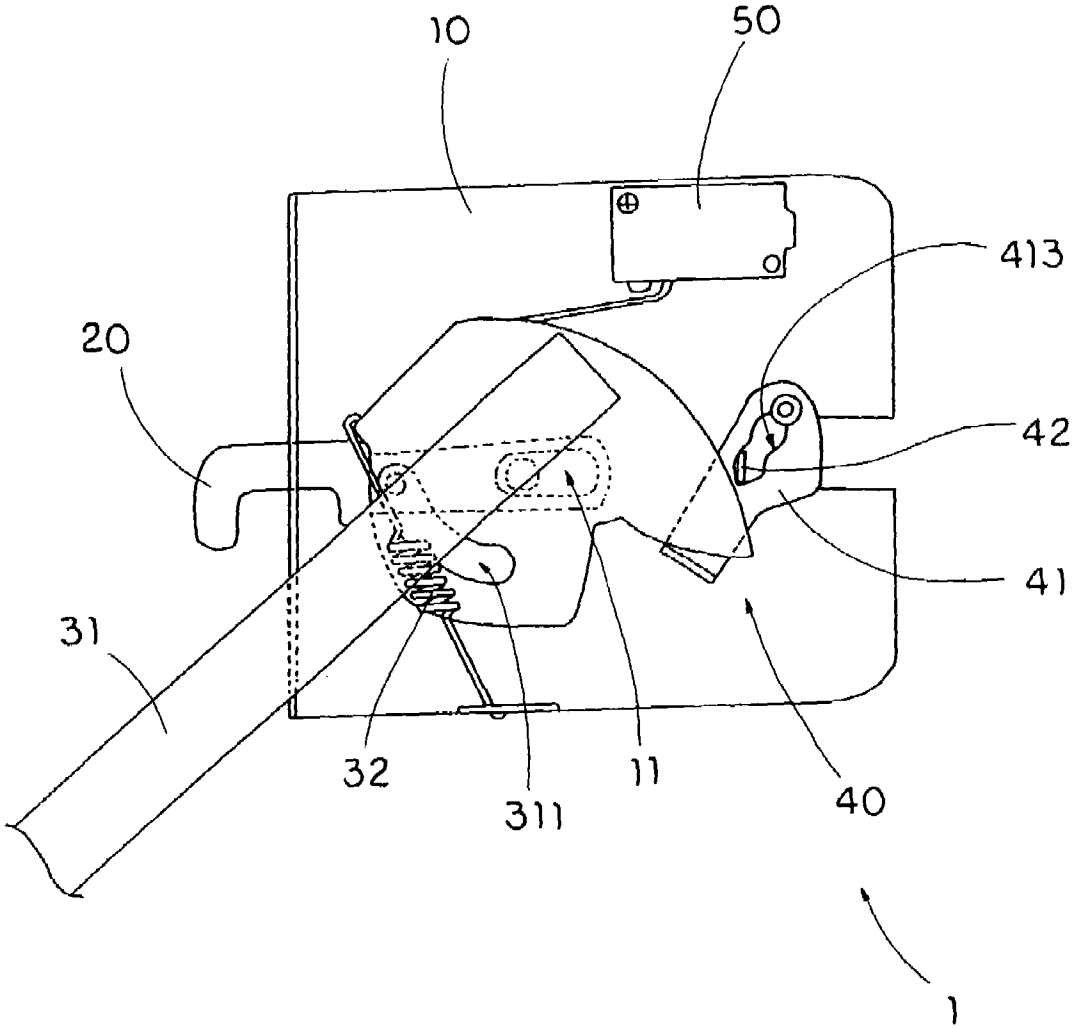
FIG. 3 is a schematic diagram of the mechanical latch assembly according to the above first preferred embodiment of the present invention, illustrating that the locking latch is in the locked position while the locker member is subject to the elevated operation temperature.
Figure 4:
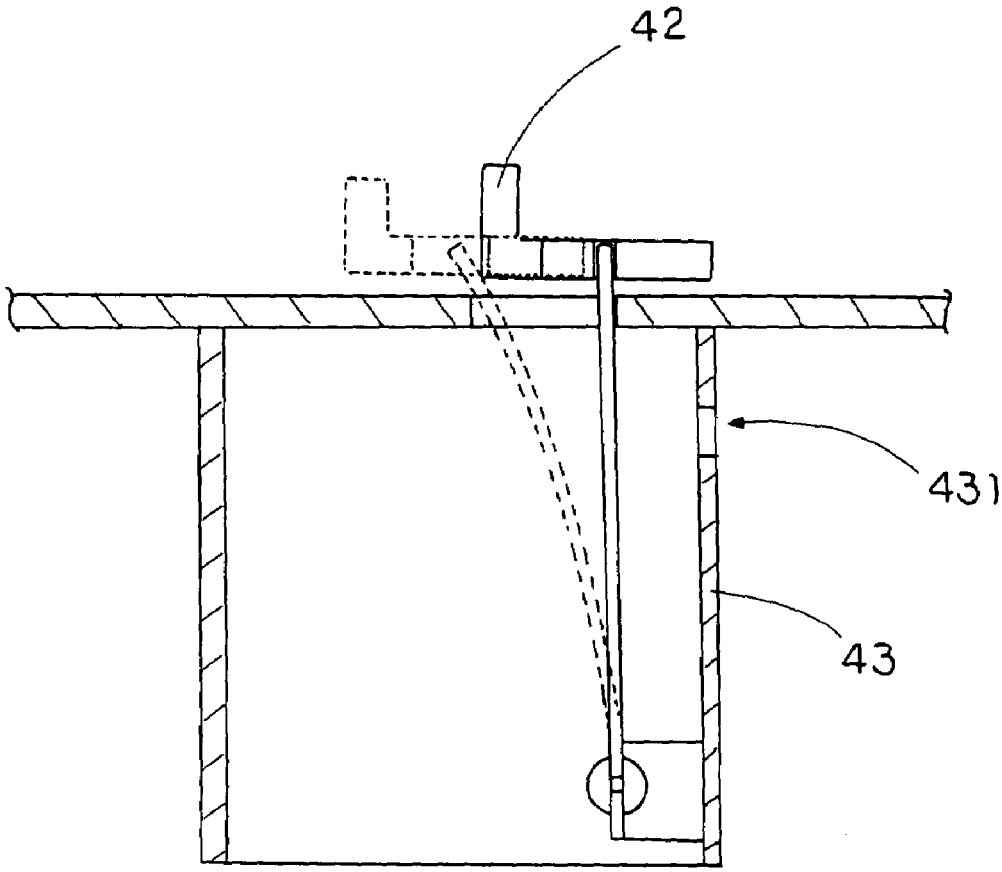
FIG. 4 is a sectional view of the mechanical latch assembly according to the above first preferred embodiment of the present invention.

Referring to FIG. 2 to FIG. 4 of the drawings, the safety lock arrangement 40 further comprises a thermal activated arm 42 substantially extended from the supporting frame 10 to slidably pass through the slider slot 411 of the locker member 41 at a safety temperature, wherein when the thermal activated arm 42 is heated up at an elevated operation temperature, the thermal activated arm 42 is deflected to push the locker member 41 at the pusher surface 412 such that the locker member 41 is moved to engage with the actuation arrangement 30 so as to lock up the actuation handle 31 while the locking latch 20 is at the locked position, wherein when the thermal activated arm 42 is cooled down to the safety temperature, the thermal activated arm 42 is restored to push the locker member 41 at the retracting surface 413 so that the locker member 41 is normally disengaged with the actuation arrangement 30 in such a manner that the actuation handle 31 is allowed to actuate the locking latch 20 to the unlocked position.

Referring to FIG. 1 of the drawings, the supporting frame 10 has a linear guiding channel 11 longitudinally formed thereon wherein the locking latch 20 is slidably mounted on the linear guiding channel 11 so as to slidably mount on the supporting frame 10 in the above-mentioned longitudinally movable manner between the locked position and the unlocked position.

The actuation handle 31 has a driving portion pivotally connected to the supporting frame 10 and a gripping portion outwardly extended from the driving portion and adapted being driven by a user of the present invention. According to the first preferred embodiment, the actuation handle 31 has a pivot channel 311, which is curved in shape, formed transversely on the driving portion wherein a connecting portion of the locking latch 20 is slidably connected with the pivot channel 311 in such a manner that when the actuation handle 31 is pivotally move with respect to the supporting frame 10, the locking latch 20, being slidably connected with the pivot channel 311, is arranged to be driven to move longitudinally along the linear guiding channel 11 between the locked position and the unlocked position.

It is worth mentioning that in order to facilitate smooth movement of the actuation handle 31 and the locking latch 20, a radius of curvature of the pivot channel 311 should be substantially the same as the radius of curvature of a pivotal movement of the actuation handle 31 with respect to the supporting frame 10 so that when the actuation handle 31 is pivotally moving with respect to the supporting frame 10, the locking latch 20 is capable of substantially and smoothly guided by the pivot channel 311.

On the other hand, the slider slot 411 of the locker member 41 has a contracted central portion, and two enlarged end portions to define the pusher surface 412 and the opposed retracting surface 413 thereon wherein the thermal arm 42 is normally retained in the slider slot 411 for retaining the actuation handle 31 disengaging with the locker member 41. At such, the actuation handle 31 is capable of being freely and pivotally moved with respect to the supporting frame 10. In other words, at the room temperature, a user of the present invention may freely move the actuation handle 31 so as to drive the locking latch moving between the locked position and the unlocked position. As shown in FIG. 1 of the drawings, the slider slot 411 is therefore formed as a bow-tie shape.

Referring to FIG. 4 of the drawings, the thermal arm 42 comprises at least an elongated bi-metal strip which comprises a first and a second metallic member securely affixed together in a side-by-side manner. Moreover, each of the first and the second metallic members has a predetermined yet different performance of thermal expansion, such as a different coefficient of linear expansion. As such, when the first and the second metallic member both subject to a predetermined elevated temperature, they will expand to a different extent. Since the first and the second metallic members are securely bound together, when they expand in different magnitude as governed by their respective coefficient of linear expansion, the thermal arm 42 will tend to deflect in the direction of the metallic member which has a smaller expansion, thus creating an urging force in the direction just mentioned.

Back to the slider slot 411, in which the thermal arm 42 is normally retained, where the thermal arm 42 is subject to an elevated operation temperature, such as that required in the main housing for a particular purpose, such as heat treatment, the thermal arm 42 is arranged to be deflected to push the pusher surface 412 so as to drive the locker member 41 moving to engage with the driving portion of the actuation handle 31 of the actuation arrangement 30 while the locking latch 20 is driven into the locked position. In other words, the actuation handle is substantially restricted from manually moving back for driving the locking latch 20 to move back to the unlocked position.

When the temperature at which the thermal arm 42 is subject lowers to the predetermined safety temperature, the thermal arm 42 will tend to restore to its original shape, and in the course of restoring, it will thus exert an urging force to the retracting surface 413 of the slider slot 411 so as to push the locker member 41 disengaging with the actuation arrangement 30.

According to the first preferred embodiment, the locker member 41 is elongated in shape and has one pivot end pivotally mounted on the supporting frame 10, and an engaging head extended from the pivot end and adapted to engage with the actuation arrangement 30, as shown, for example, in FIG. 1 of the drawings. In other words, the thermal arm 42 is adapted to pivotally drive the locker member 41 to engage or disengage with the actuation arrangement 30.

In order to better retain the actuation handle 31, the actuation arrangement 30 further comprises means for retaining the actuation handle 31 such that the locking latch 20 is capable of being retained in its locked or unlocked position. Referring to FIG. 1 of the drawings, the retaining means comprises a resilient element 32 having one end mounted on the supporting frame 10 and another end mounted to the driving portion of the actuation handle 31 so as to normally exert a tangential force to the driving portion of the actuation handle 31 for normally retaining the actuation handle 31 in such a position that the locking latch 20 is kept in either the locked position or the unlocked position. This retaining means substantially prevent accidental displacement of the actuation handle 31.

It is worth mentioning that however, the retaining means is not meant to lock the actuation handle 31 so as to substantially restrict its pivotal movement about the supporting frame 10. What is intended to achieve by the retaining means is to loosely retaining the position of the actuation handle 31 so as to prevent accidental movement thereof. Once the locker member 41 reaches the elevated operation temperature, the actuation handle 31 would then be substantially locked by the locker member 41.

Moreover, the mechanical latch assembly 1 further comprises an operation sensor 50 mounted on the supporting frame 10 wherein the driving portion of the actuation handle 31 is adapted to activate the operation sensor 50 when it is pivotally moved to drive the locking latch 20 slidably moving into the locked position. In other words, the operation sensor 50 is adapted to detect whether or not the locking latch 20 is properly operated.

Referring to FIG. 4 of the drawings, in order to protect the thermal arm 42 from possible physical damage, the safety lock arrangement 40 further comprises a locker housing 43 provided underneath the supporting frame 10 wherein the thermal arm 42 is received in the locker housing 43 and extended through the supporting frame 10 into the slider slot 411.

Moreover, the locker housing 43 has one heat transfer opening 431 formed thereon wherein heat from the main housing is adapted to be transferred to the thermal arm 42 via the heat transfer opening 431. Thus, it is worth mentioning that by fabricating a predetermined size and shape of the heat transfer opening 431, the present invention is adapted to suit a wide variety of applications. For example, when a user desires that the thermal arm to be heated up slowly, a corresponding size of the heat transfer opening may be made in order to achieve the specific application.

Figure 5:
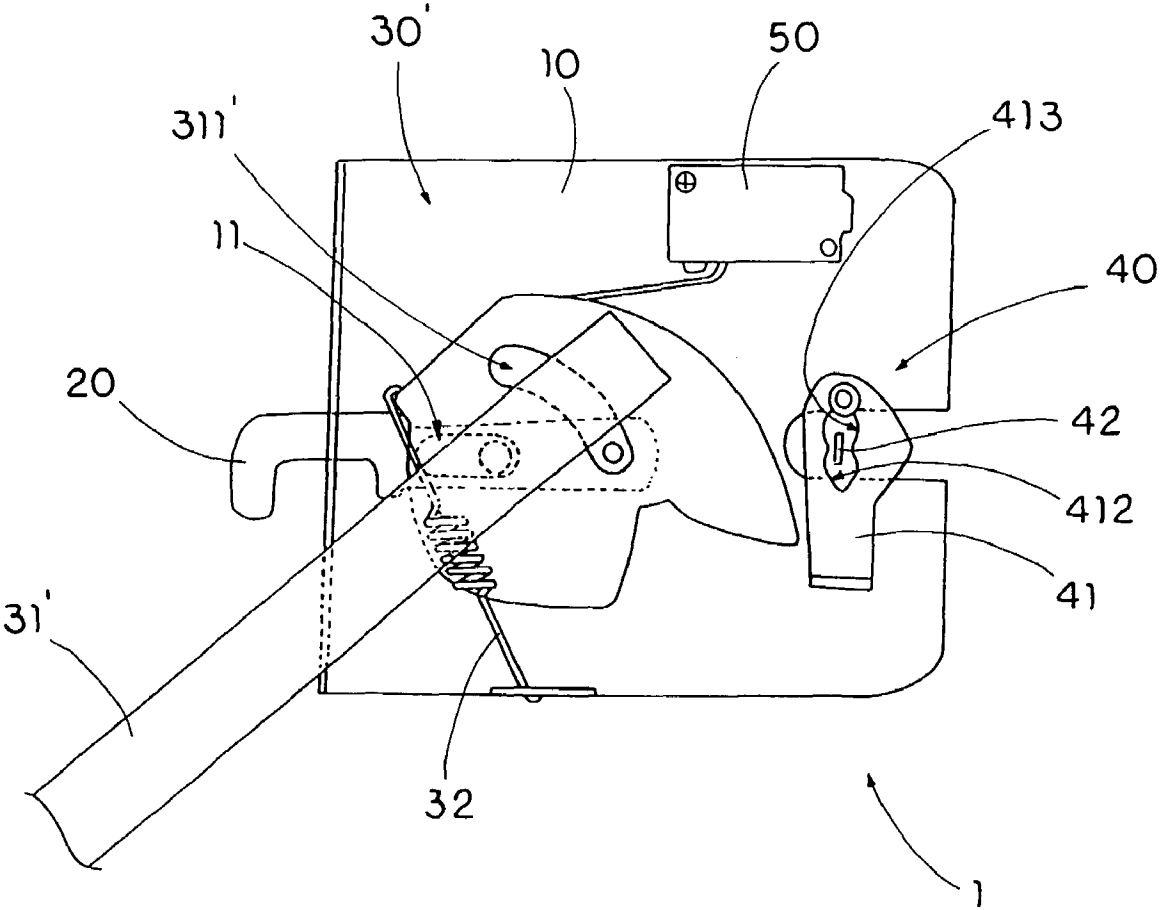
FIG. 5 is an alternative mode of the mechanical latch assembly according to the above first preferred embodiment of the present invention.

It is important to point out that in order to minimize a size of the supporting frame 10, the driving portion of the actuation handle 31 is extended above a front portion of the supporting frame 10 wherein the pivot channel 311 is formed on the driving portion of the actuation handle 31. Moreover, the linear guiding channel 11 is formed rearwardly from the pivot channel 311 on the supporting frame 10. As a result, a distance between a front side edge of the supporting frame 10 and the pivotal point at which the actuation handle 31 is mounted can be fully utilized to form the pivot channel 311 such that a rear portion of the supporting frame 10 can be minimize in size so as to make the supporting frame 10 compact. Alternatively, as shown in FIG. 5 of the drawings, the driving portion of the actuation handle 31' of the actuation arrangement 30' is formed above a rear portion of the supporting frame 10 wherein the pivot channel 311' is formed on the driving portion. Then, the linear guiding channel 11 is frontwardly extended on the supporting frame 10' from the pivot channel 311' for linearly connecting with the locking latch 20.

It is important to point out that for accomplishing the above-mentioned objectives, a cross section of the thermal arm 42 may be made to different shapes, such as an U-shape, or an L-shape, so long as it is adapted to push the pusher surface 412 for driving the locker member 41 to engage with the actuation arrangement 30 when subject to the operation temperature, and to push the retracting surface 413 for disengaging the locker member 41 from the actuation arrangement 30 when the thermal arm 42 is subject to the safety temperature.

Figure 6:
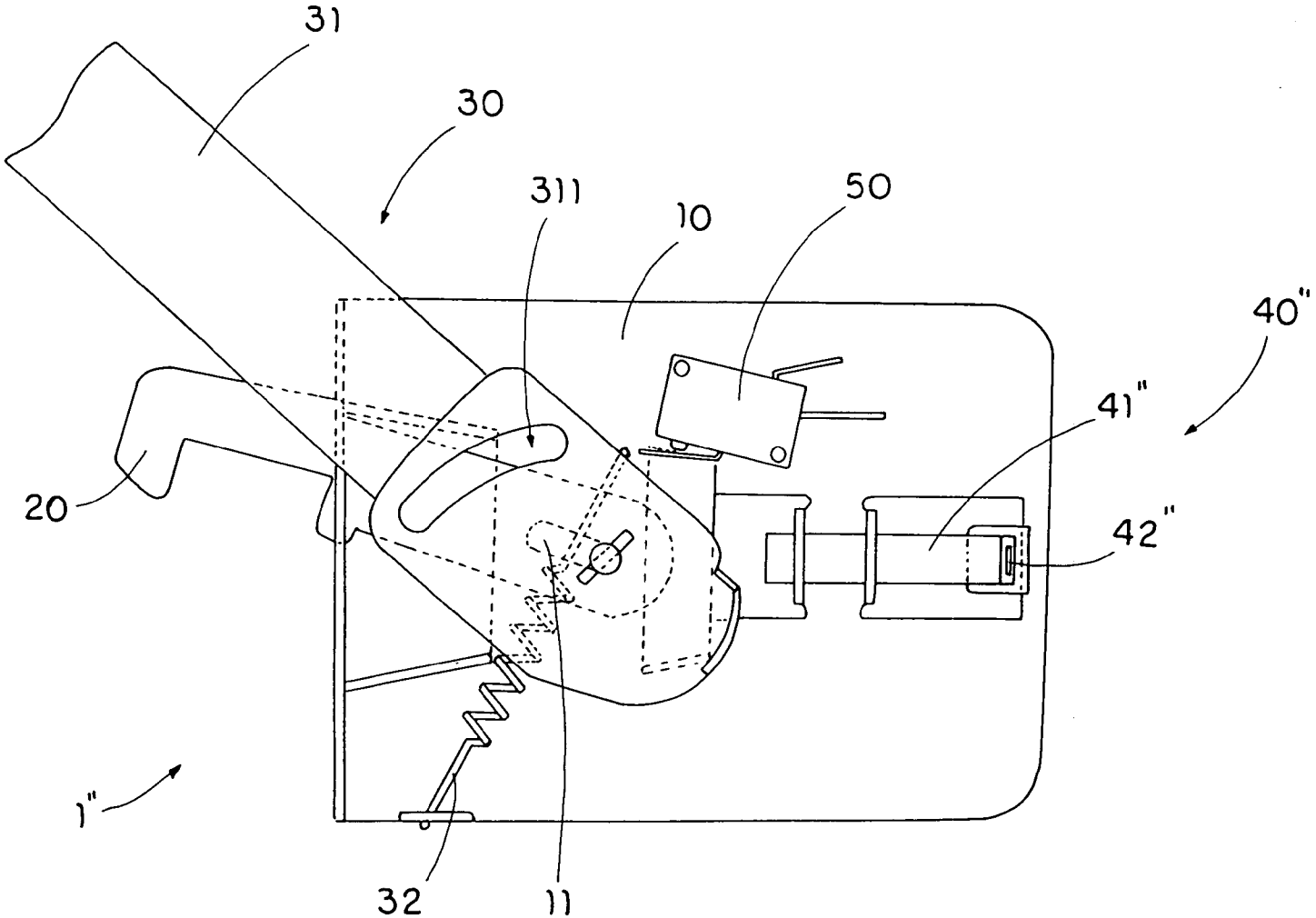
FIG. 6 is a plan view of a mechanical latch assembly according to a second preferred embodiment of the present invention.
Figure 7:
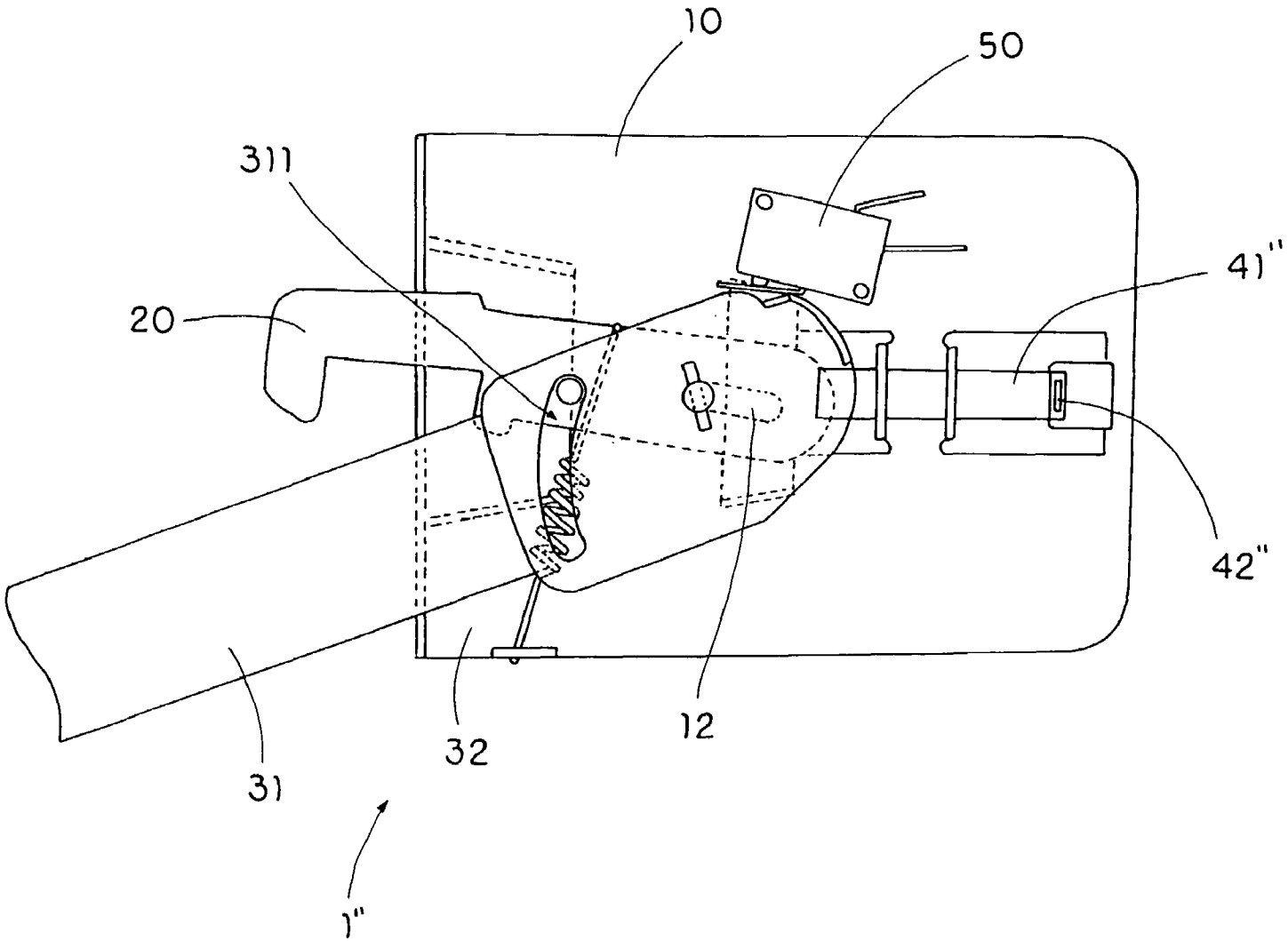
FIG. 7 is a plan view of a mechanical latch assembly according to a second preferred embodiment of the present invention, illustrating that the actuation arrangement is engaged with the locker member.
Figure 8:
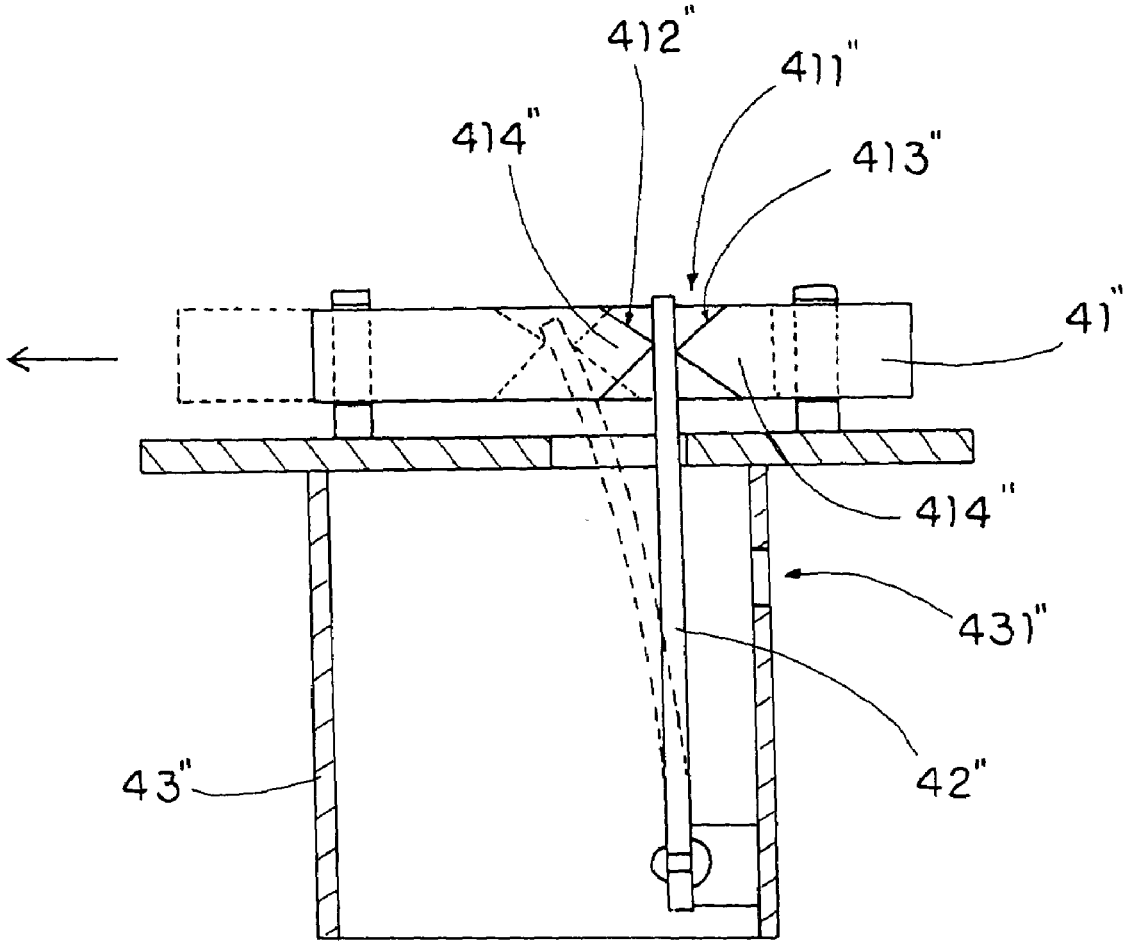
FIG. 8 is a section view of the mechanical latch assembly according to the above second preferred embodiment of the present invention.

Referring to FIG. 6 to FIG. 8 of the drawings, a mechanical latch assembly 1" according to a second preferred embodiment of the present invention is illustrated. The second preferred embodiment is similar to the first preferred embodiment except the safety lock arrangement 40".

The safety lock arrangement 40" comprises a locker member 41" movably mounted on the supporting frame, wherein the locker member 41 has a slider slot 411" formed thereon to define a pusher surface 412" and an opposed retracting surface 413".

The safety lock arrangement 40" further comprises a thermal activated arm 42" substantially extended from the supporting frame 10 to slidably pass through the slider slot 411" of the locker member 41" at a safety temperature, wherein when the thermal activated arm 42" is heated up at an elevated operation temperature, the thermal activated arm 42" is deflected to push the locker member 41" at the pusher surface 412" such that the locker member 41" is moved to engage with the actuation arrangement 30 so as to lock up the actuation handle 31 while the locking latch 20 is at the locked position, wherein when the thermal activated arm 42" is cooled down to the safety temperature, the thermal activated arm 42" is restored to push the locker member 41" at the retracting surface 413" so that the locker member 41" is normally disengaged with the actuation arrangement 30 in such a manner that the actuation handle 31 is allowed to actuate the locking latch 20 to the unlocked position.

According to the second preferred embodiment, as shown in FIG. 6 and FIG. 7 of the drawings, the locker member 41" is adapted to longitudinally move between the locked position and the unlocked position wherein the locker member 41" further has two pusher forming members 414", each of which being in a shape of a pyramid, inwardly extended from two sidewalls of the slider slot 411 to define two opposedly inclined surfaces as the pusher surface 412" and the retracting surface 413" in such a manner that the thermal arm 42" is extended to pass through a central portion of the slider slot 411" between the two pusher forming members 414".

Similar to those disclosed in the above first preferred embodiment, the thermal arm 42" is also preferably embodied as an elongated bi-metal strip which comprises a first and a second metallic member securely affixed together in a side-by-side manner. Moreover, each of the first and the second metallic members has a predetermined yet different performance of thermal expansion, such as a different coefficient of linear expansion. As such, when the first and the second metallic member both subject to a predetermined elevated temperature, they will expand to a different extent. Since the first and the second metallic members are securely bound together, when they expand in different magnitude as governed by their respective coefficient of linear expansion, the thermal arm 42 will tend to deflect in the direction of the metallic member which has a smaller expansion, thus creating an urging force in the direction just mentioned.

As a result, when the thermal arm 42" is subject to an elevated operation temperature, such as that required in the main housing for a particular purpose, such as heat treatment, the thermal arm 42" is arranged to be deflected to push the pusher surface 412" so as to drive the locker member 41" longitudinally moving to engage with the driving portion of the actuation handle 31 of the actuation arrangement 30 while the locking latch 20 is driven into the locked position. In other words, the actuation handle is substantially restricted from manually moving back for driving the locking latch 20 to move back to the unlocked position.

When the temperature at which the thermal arm 42" is subject lowers to the predetermined safety temperature, the thermal arm 42" will tend to restore to its original shape, and in the course of restoring, it will thus exert an urging force to the retracting surface 413" of the slider slot 411" so as to push the locker member 41" longitudinally disengaging with the actuation arrangement 30".

Figure 9:
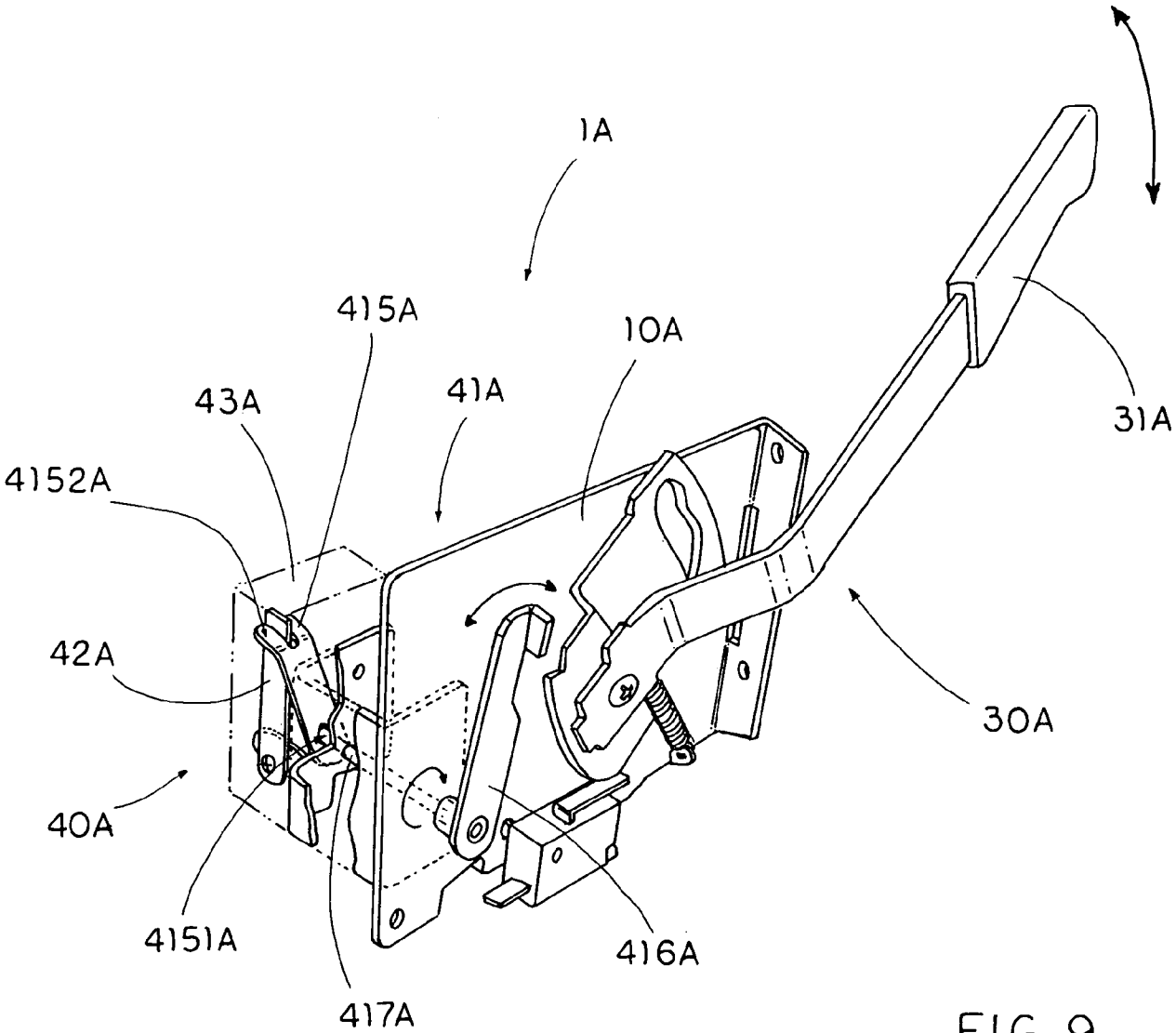
FIG. 9 is a perspective view of a mechanical latch assembly according to a third preferred embodiment of the present invention.
Figure 10B:
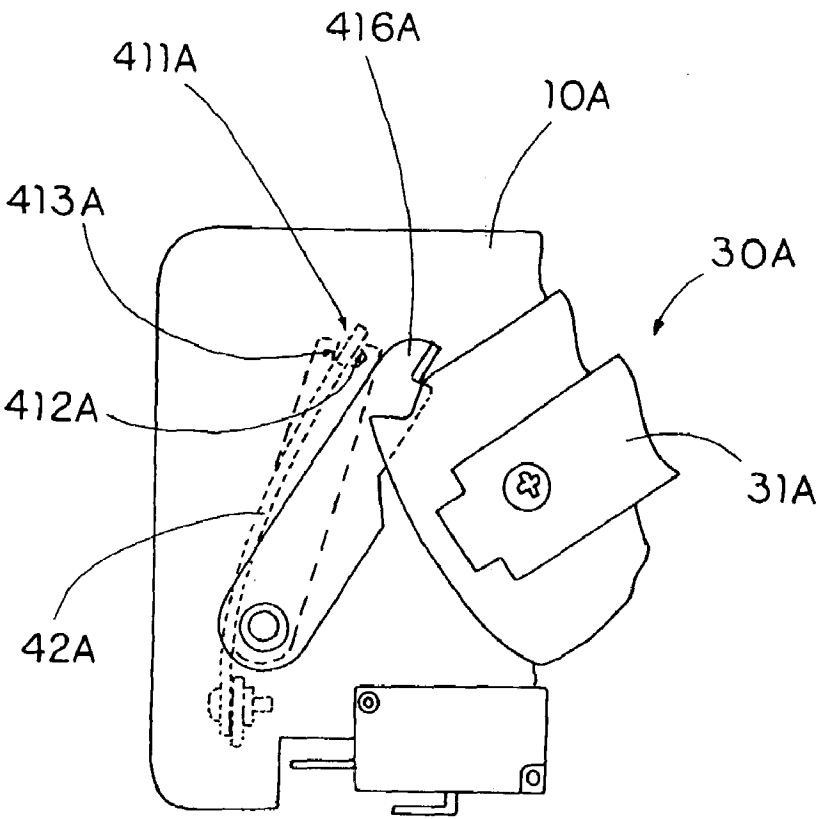
FIG. 10A and FIG. 10B are section views of the mechanical latch assembly according to the above third preferred embodiment of the present invention, illustrating that the locking latch is in the locked position and unlocked position respectively.
Figure 10A:
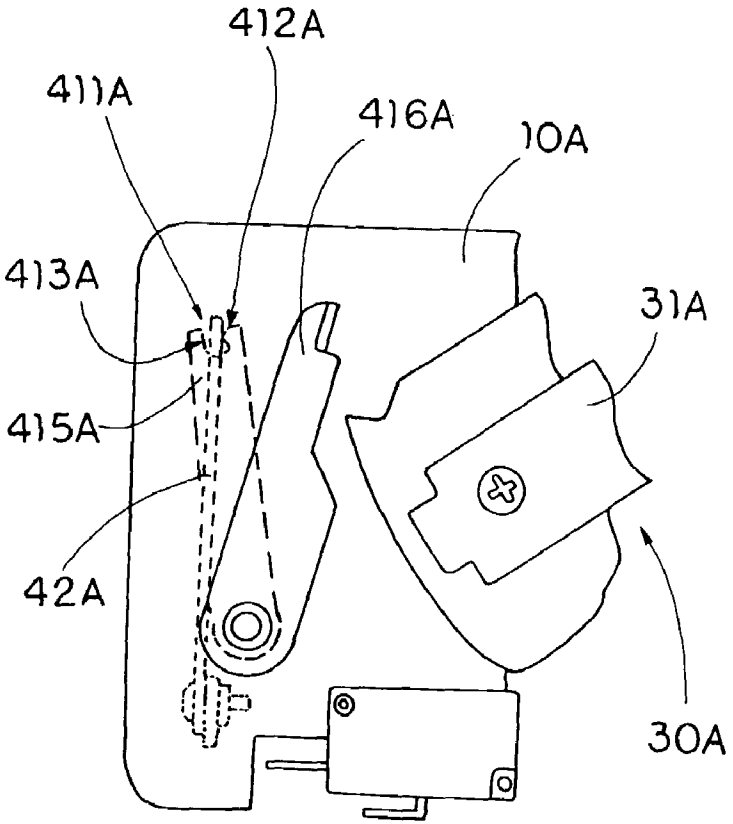

Referring to FIG. 9, FIG. 10A and FIG. 10B of the drawings, the mechanical latch assembly 1A according to a third preferred embodiment of the present invention is illustrated. The third preferred embodiment is similar to the first preferred embodiment except the safety lock arrangement 40A.

According to the third preferred embodiment, the thermal arm 42A is received in the locker housing 43A which is spacedly provided underneath the supporting frame 10A, wherein the locker member 41A comprises an engaging piece 416A having a pivot end and an engaging head extended to engage with the actuation arrangement 30A, a driving piece 415A mounted in the locker housing 43A for communicating with the thermal arm 42A, and a driving shaft 417A rotatably extended between the driving piece 415A and the engaging piece 416A in such a manner that the driving piece 415A is adapted to be pivotally driven by the thermal arm 42A so as to drive the driving shaft 417A to rotate for driving the engaging piece 416A engaging with the actuation member 30A.

Referring to FIG. 9 of the drawings, the driving piece 415A is elongated in shape having a pivot end portion 4151A connecting with the driving shaft 417A, and another driven end portion 4152A transversely extended therefrom to form the slider slot 411A and having the pusher surface 412A and the retracting surface 413A as two sidewalls of the slider slot 411A, wherein the thermal arm 42A is normally retained in the slider slot 411A at the driven end portion 4152A for retaining the actuation handle 31A disengaging with the locker member 41A. At such, the actuation handle 31A is capable of being freely and pivotally moved with respect to the supporting frame 10A. In other words, the driving piece 415A has an L-shaped cross section pivotally mounted within the locker housing 43A.

As in the first preferred embodiment, the thermal arm 42A comprises at least an elongated bi-metal strip which comprises a first and a second metallic member securely affixed together in a side-by-side manner. Moreover, each of the first and the second metallic members has a predetermined yet different performance of thermal expansion, such as a different coefficient of linear expansion. As such, when the first and the second metallic member both subject to a predetermined elevated temperature, they will expand to a different extent. Since the first and the second metallic members are securely bound together, when they expand in different magnitude as governed by their respective coefficient of linear expansion, the thermal arm 42A will tend to deflect in the direction of the metallic member which has a smaller expansion, thus creating an urging force in the direction just mentioned.

Back to the slider slot 411A, in which the thermal arm 42A is normally retained, where the thermal arm 42A is subject to an elevated operation temperature, such as that required in the main housing for a particular purpose, say, for heat treatment, the thermal arm 42A is arranged to be deflected to push the pusher surface 412A so as to drive the driven end portion 4152A of the driving piece 415A pivotally moving with respect to the pivot end portion 4151A in the locker housing 43A for driving the driving shaft 417A rotating about the pivot end portion 4151A of the driving piece 415A.

The driving shaft 417A then drives the engaging piece 416A of the locker member 41A pivotally moving to engage with the driving portion of the actuation handle 31A of the actuation arrangement 30A while the locking latch 20 is driven into the locked position. In other words, the actuation handle 31A is substantially restricted from manually moving back for driving the locking latch 20 to move back to the unlocked position.

When the temperature at which the thermal arm 42A is subject lowers to the predetermined safety temperature, the thermal arm 42A will tend to restore to its original shape, and in the course of restoring, it will thus exert an urging force to the retracting surface 413A of the slider slot 411A so as to push the locker member 41A disengaging with the actuation arrangement 30A. It is also worth to mention that, alternatively, the thermal arm 42A can be made with two bi-metals or more in series to fine tune the thermal characteristics of the system. The multiple bi-metals could be welded end to end or riveted, screwed, etc on a small portion of the face. Also, bi-metals could be aiding or moving in opposite directions at various temperatures.

From the foregoing descriptions, it can be shown that the above objects have been substantially achieved. The present invention successfully provides a mechanical latch assembly 1 wherein a locking and unlocking thereof is determined by an accurate mechanical response of the safety lock arrangement 40 so that no electronic control to the mechanical latch assembly 1 is necessary. Thus, the manufacturing cost and the ultimate selling price of the present invention can be minimized.

One skilled in the art will understand that the embodiment of the present invention as shown in the drawings and described above is exemplary only and not intended to be limiting. It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A mechanical latch assembly, comprising:

a supporting frame;

a locking latch slidably mounted on said supporting frame in longitudinally movable manner;

an actuation arrangement comprising an actuation handle pivotally connected to said supporting frame to longitudinally drive said locking latch moving between a locked position that said locking latch is outwardly slid on said supporting frame and an unlocked position that said locking latch is inwardly slid on said supporting frame; and a safety lock arrangement, comprising:

a locker member movably mounted on said supporting frame, wherein said locker member has a slider slot formed thereon to define a pusher surface and an opposed retracting surface; and a thermal arm substantially extended from said supporting frame to slidably pass through said slider slot of said locker member at a safety temperature, wherein when said thermal activated arm is heated up at an operation temperature, said thermal activated arm is deflected to push said locker member at said pusher surface such that said locker member is moved to engage with said actuation arrangement so as to lock up said actuation handle while said locking latch is at said locked position, wherein when said thermal activated arm is cooled down to said safety temperature, said thermal activated arm is restored to push said locker member at said retracting surface that said locker member is normally disengaged with said actuation arrangement such that said actuation handle is allowed to actuate said locking latch to said unlocked position.

2. The mechanical latch assembly, as recited in claim 1, wherein said actuation handle has a driving portion pivotally connected to said supporting frame and a gripping portion outwardly extended from said driving portion, wherein said actuation handle has a pivot channel, which is curved in shape, transversely formed on said driving portion wherein that a connecting portion of said locking latch is slidably connected with said pivot channel in such a manner that when said actuation handle is pivotally moved with respect to said supporting frame, said locking latch, being slidably connected with and said pivot channel, is arranged to be driven to move longitudinally along said linear guiding channel between said locked position and said unlocked position.

3. The mechanical latch assembly, as recited in claim 2, wherein said safety lock arrangement further comprises a locker housing, having a heat transfer opening formed thereon, provided underneath said supporting frame wherein the thermal arm is received in said locker housing and extended through said supporting frame into said slider slot, wherein heat is transferred to said thermal arm for said deflection through said heat transfers opening.

4. The mechanical latch assembly, as recited in claim 3, wherein said locker member is elongated in shape and has one pivot end pivotally mounted on said supporting frame, and an engaging head extended from said pivot end and adapted to be pivotally driven to engage with said actuation arrangement when said thermal arm is subject to said operation temperature.

5. The mechanical latch assembly, as recited in claim 4, wherein said thermal arm is an elongated bi-mental strip which comprises a first and a second metallic member securely affixed together in a side-by-side manner, wherein each of said first and second metallic member has a predetermined different coefficient of linear expansion so that when said first and second metallic member are subject to said elevated operation temperature, said first and said second metallic member are expanded in a different magnitude for forming said predetermined deflection of said thermal arm so as to push said pusher surface of said locker member to engage with said actuation arrangement.

6. The mechanical latch assembly, as recited in claim 5, wherein a radius of curvature of said pivot channel is substantially the same as a radius of curvature of said pivotal movement of said actuation handle with respect to said supporting frame so that when said actuation handle is pivotally moving with respect to said supporting frame, said locking latch is capable of substantially and smoothly guided by said pivot channel for moving between said locked position and said unlocked position.

7. The mechanical latch assembly, as recited in claim 6, wherein driving portion of said actuation handle is transversely formed above a front portion of said supporting frame wherein said pivot channel is formed on said driving portion and said linear guiding channel is formed rearwardly from said pivot channel on said supporting frame.

8. The mechanical latch assembly, as recited in claim 7, wherein said actuation arrangement further comprises a resilient element having one end mounted on said supporting frame and another end mounted to said driving portion of said actuation handle so as to normally exert a tangential force to said driving portion of said actuation handle for normally retaining said actuation handle in position for keeping said locking latch in said locked position and in said unlocked position.

9. The mechanical latch assembly, as recited in claim 8, further comprising an operation sensor mounted on said supporting frame wherein said driving portion of said actuation handle is adapted to activate said operation sensor when said actuation handle is pivotally moved to drive said locking latch slidably moving into said locked position.

10. The mechanical latch assembly, as recited in claim 6, wherein said driving portion of said actuation handle is formed above a rear portion of said supporting frame wherein said pivot channel is transversely formed on said driving portion, and said linear guiding channel is frontwardly extended on said supporting frame from said pivot channel for linearly connecting with said locking latch.

11. The mechanical latch assembly, as recited in claim 10, wherein said actuation arrangement further comprises a resilient element having one end mounted on said supporting frame and another end mounted to said driving portion of said actuation handle so as to normally exert a tangential force to said driving portion of said actuation handle for normally retaining said actuation handle in position for keeping said locking latch in said locked position and in said unlocked position.

12. The mechanical latch assembly, as recited in claim 11, further comprising an operation sensor mounted on said supporting frame wherein said driving portion of said actuation handle is adapted to activate said operation sensor when said actuation handle is pivotally moved to drive said locking latch slidably moving into said locked position.

* * * * *